US009731875B2

(12) United States Patent
Wilson et al.

(10) Patent No.: US 9,731,875 B2
(45) Date of Patent: Aug. 15, 2017

(54) INJECTION CLOSURE SYSTEM

(71) Applicant: MCCORMICK & COMPANY, INCORPORATED, Sparks, MD (US)

(72) Inventors: Tracie L. C. Wilson, Westminster, MD (US); James A. Whisenhunt, Independence, MO (US); Darin Pugne, Pittsburgh, PA (US)

(73) Assignee: MCCORMICK & COMPANY, INCORPORATED, Sparks, MD (US)

( * ) Notice: Subject to any disclaimer, the term of this patent is extended or adjusted under 35 U.S.C. 154(b) by 0 days.

(21) Appl. No.: 14/211,865

(22) Filed: Mar. 14, 2014

(65) Prior Publication Data

US 2014/0263473 A1 Sep. 18, 2014

Related U.S. Application Data

(60) Provisional application No. 61/798,509, filed on Mar. 15, 2013.

(51) Int. Cl.
*B65D 47/12* (2006.01)
*B65D 47/42* (2006.01)
(Continued)

(52) U.S. Cl.
CPC ..... *B65D 47/127* (2013.01); *B65D 1/0246* (2013.01); *B65D 47/42* (2013.01);
(Continued)

(58) Field of Classification Search
CPC ..... B65D 25/48; B65D 47/06; B65D 35/38; B65D 47/42; B65D 51/18; B65D 47/127;
(Continued)

(56) References Cited

U.S. PATENT DOCUMENTS 1,661,595 A * 3/1928 Bowen ..... A22C 17/0053 99/532
2,014,149 A * 9/1935 Stafford ..... 401/264
(Continued)

FOREIGN PATENT DOCUMENTS

FR 1 117 891 5/1956
GB 2 316 397 2/1998
(Continued)

OTHER PUBLICATIONS

International Search Report and Written Opinion with Search History issued Aug. 8, 2014 in PCT/US2014/026002.
(Continued)

*Primary Examiner* — Paul R Durand
*Assistant Examiner* — Robert Nichols, II
(74) *Attorney, Agent, or Firm* — Greenblum & Bernstein, P.L.C.

(57) ABSTRACT

An injection closure system includes a bottle containing a product to be distributed and a closure attached to the bottle and including nozzles. Each of the nozzles includes two holes through which the product is distributed from the bottle. The bottle includes a plurality of teeth extending around an outer surface of the bottle and the closure includes a plurality of teeth extending around an inner surface of the closure. When the closure is in a fully attached position on the bottle, the teeth of the bottle contact the teeth of the closure to prevent the closure from being removed from the bottle.

21 Claims, 13 Drawing Sheets

(51) Int. Cl.
*B65D 51/18* (2006.01)
*B65D 1/02* (2006.01)
*B65D 55/02* (2006.01)

(52) U.S. Cl.
CPC ..... *B65D 51/18* (2013.01); *B65D 55/022* (2013.01); *B65D 2251/0025* (2013.01); *B65D 2251/0078* (2013.01)

(58) Field of Classification Search
CPC ..... B65D 55/022; B65D 2251/0025; B65D 2251/0078; B65D 1/0246; A23B 4/28
USPC ..... 222/482, 478, 567, 562, 153.09, 485, 222/153.01, 568, 153.05, 153.1; 215/44, 215/228, 329; 99/494, 532
See application file for complete search history.

(56) References Cited

U.S. PATENT DOCUMENTS 2,670,673 A * 3/1954 Gordon ..... A22C 9/001 222/385
2,802,604 A * 8/1957 Ebberts ..... 222/207
2,922,425 A * 1/1960 Lerner et al. ..... 132/212
2,968,262 A * 1/1961 Lacey ..... 425/183
3,191,809 A * 6/1965 Schultz et al. ..... 222/182
3,410,457 A * 11/1968 Brown ..... A47G 21/004 222/191
3,457,928 A 7/1969 Kurshenoff
3,754,469 A * 8/1973 Gasior ..... A22C 17/0053 99/494
3,770,155 A 11/1973 Novitch
3,777,655 A * 12/1973 Ainsworth ..... A23B 4/28 30/123.3
3,788,549 A * 1/1974 Ostrowsky ..... 239/309
3,991,908 A * 11/1976 Thomas ..... B65D 83/0409 215/218
4,005,226 A * 1/1977 Dykes ..... A22C 9/001 426/281
4,119,022 A * 10/1978 Dykes ..... A22C 9/001 222/402.1
4,129,066 A * 12/1978 Corley ..... A47J 43/16 99/345
4,310,105 A * 1/1982 Gach ..... 222/153.02
4,940,167 A * 7/1990 Fillmore et al. ..... 222/153.09
5,062,550 A * 11/1991 Singh ..... 222/80
5,845,651 A * 12/1998 de Nervo ..... 132/114
5,934,187 A * 8/1999 Leon ..... 99/516
6,732,888 B1 * 5/2004 Smiley et al. ..... 222/485
6,857,530 B2 2/2005 Yourist
6,997,796 B1 * 2/2006 Wangler ..... A22C 9/007 452/102
7,549,369 B2 * 6/2009 Zimmerman ..... A47J 37/06 222/146.5
D706,631 S 6/2014 Wilson et al.
2004/0016440 A1 1/2004 De Laforcade
2007/0068544 A1 3/2007 Hackl
2010/0107902 A1 * 5/2010 Wangler ..... A47J 43/16 99/532
2011/0083567 A1 * 4/2011 Kramer ..... A47J 43/04 99/532
2012/0048826 A1 * 3/2012 Timmerman ..... 215/316
2012/0223044 A1 * 9/2012 Scott, III ..... B65D 1/0246 215/44

FOREIGN PATENT DOCUMENTS

JP 2004-049339 2/2004
WO 02/22461 3/2002
WO 2012/104607 8/2012

OTHER PUBLICATIONS

"Solvent safety bottle caps", Omnifit, https://www.chromspec.com/pdf/e/bfl6.pdf, 2009, 16 Pages.
EPO Search Report issued in EP Application No. 14771105 dated Nov. 7, 2016.

* cited by examiner

INJECTION CLOSURE SYSTEM

CROSS-REFERENCE TO RELATED APPLICATIONS

This application claims the benefit of priority of U.S. Provisional Application Ser. No. 61/798,509, "Injection Closure System" filed Mar. 15, 2013, for which the entire content is incorporated herein by reference.

BACKGROUND

The exemplary embodiments described herein are directed to an injection closure system. The system includes a bottle with an injection closure attached thereto.

Consumers of certain food products such as meat, for example steak, chicken, or fish, frequently add seasoning to their meat prior to cooking. One such seasoning is a liquid marinade. Typically, the consumer will add the marinade by pouring it over the meat and keeping the meat in the marinade for a period of time before cooking.

However, such conventional ways of seasoning the meat typically will only season the outside of the meat. Even if some of the marinade does reach the inside of the meat, the marinade is not evenly distributed throughout the meat. The result is that different parts of the meat will have different flavor.

SUMMARY

The exemplary embodiments described herein provide the consumer with a way to evenly distribute marinade within their favorite foods.

An exemplary injection closure system includes a bottle containing a product to be distributed and a closure attached to the bottle and including nozzles. Each of the nozzles includes two holes through which the product is distributed from the bottle.

Another exemplary injection closure system includes a bottle containing a product to be distributed and a closure attached to the bottle and including at least one nozzle. The bottle includes a plurality of teeth extending around an outer surface of the bottle and the closure includes a plurality of teeth extending around an inner surface of the closure. When the closure is in a fully attached position on the bottle, the teeth of the bottle contact the teeth of the closure to prevent the closure from being removed from the bottle.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION

Figure 1:
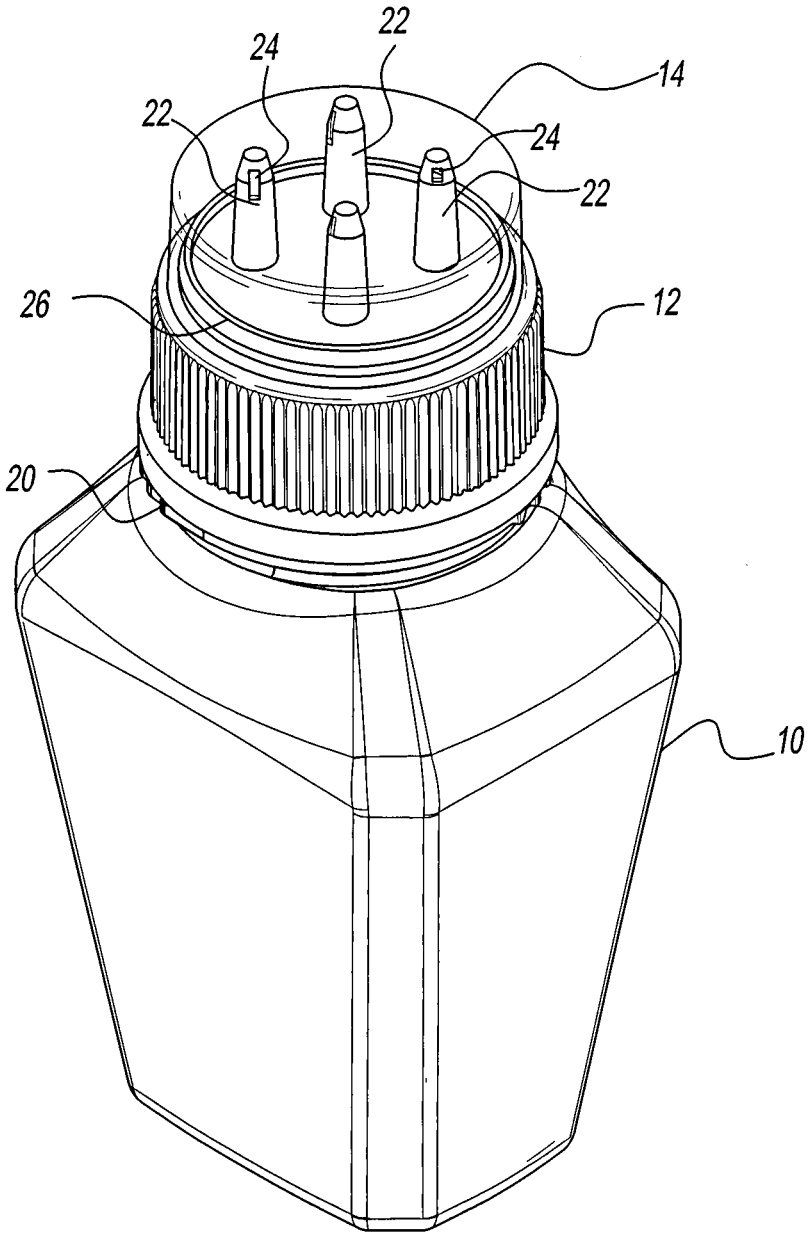
FIG. 1 shows an exemplary embodiment of the bottle with injection closure.

Referring now to the drawings, wherein like reference numerals designate identical or corresponding parts throughout the several views, FIG. 1 shows an exemplary embodiment of an injection closure system. The system includes a bottle 10 with a closure 12 attached thereto. As described more fully below, the closure 12 can be screwed onto the bottle 10. A removable overcap 14 is positioned on the closure 12.

Figure 2:
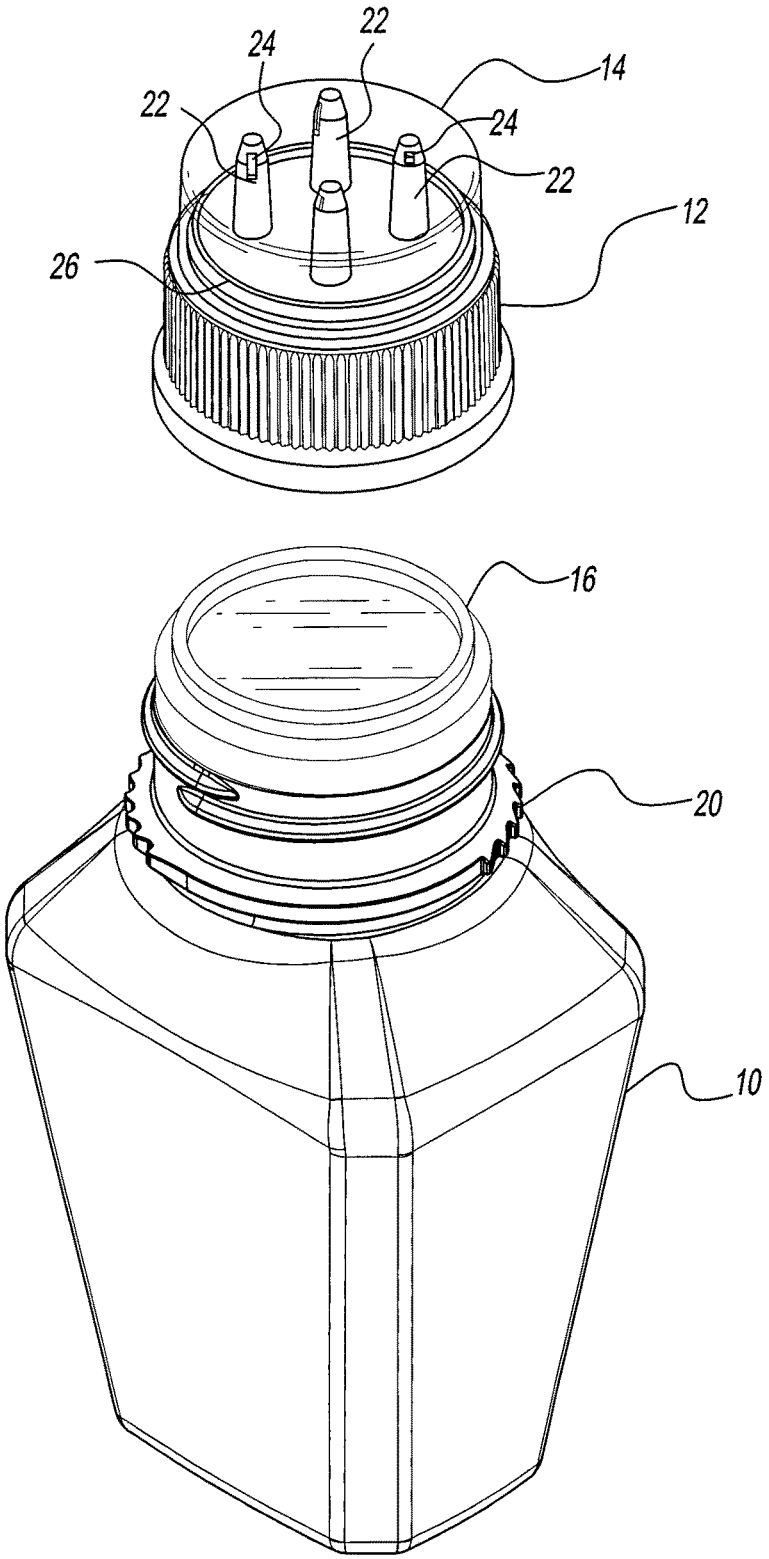
FIG. 2 shows the exemplary embodiment of FIG. 1.
Figure 17:
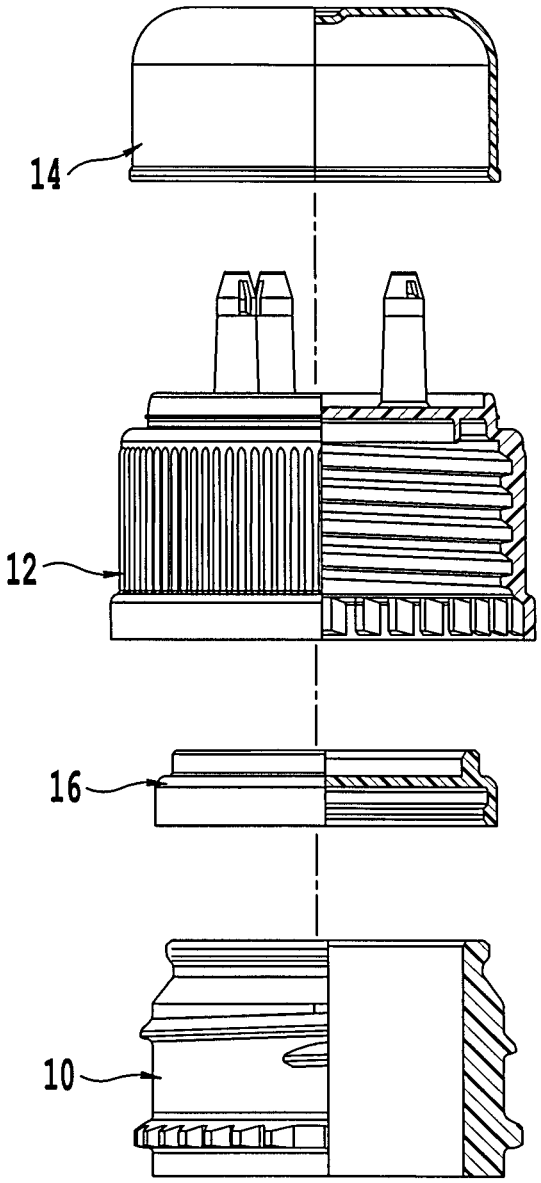
FIG. 17 shows another exemplary embodiment of the components of an injection closure system.

FIG. 2 shows a view of the exemplary embodiment of FIG. 1 with the closure 12 and overcap 14 removed from the bottle. A fitment 16 is positioned on an opening in a neck of the bottle 10 and includes a seal to close the opening of the bottle 10 in order to keep the contents of the bottle 10 fresh and provide leak resistance for the bottle 10. The seal is an induction seal inserted into the fitment 16. FIG. 17 shows an exploded view of the bottle 10, fitment 16, closure 12, and overcap 14.

Figure 6:
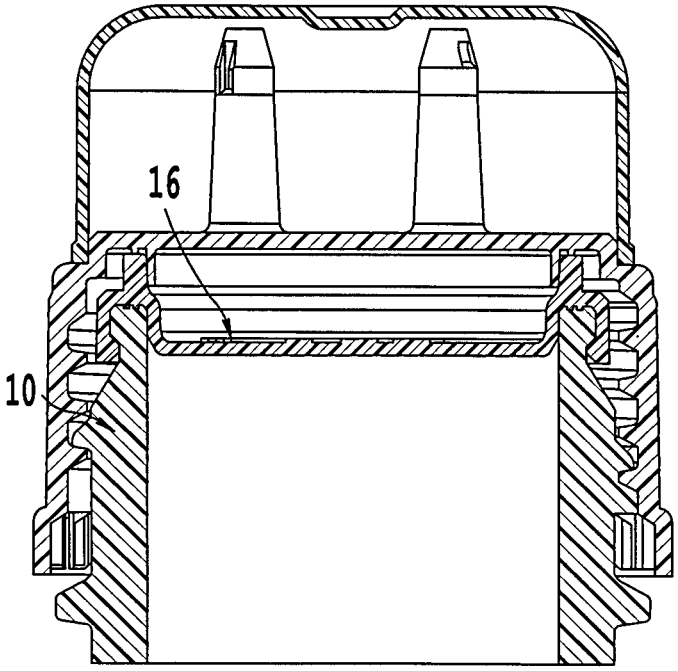
FIG. 6 shows a cross-section of an exemplary embodiment of the bottle with injection closure.
Figure 16:
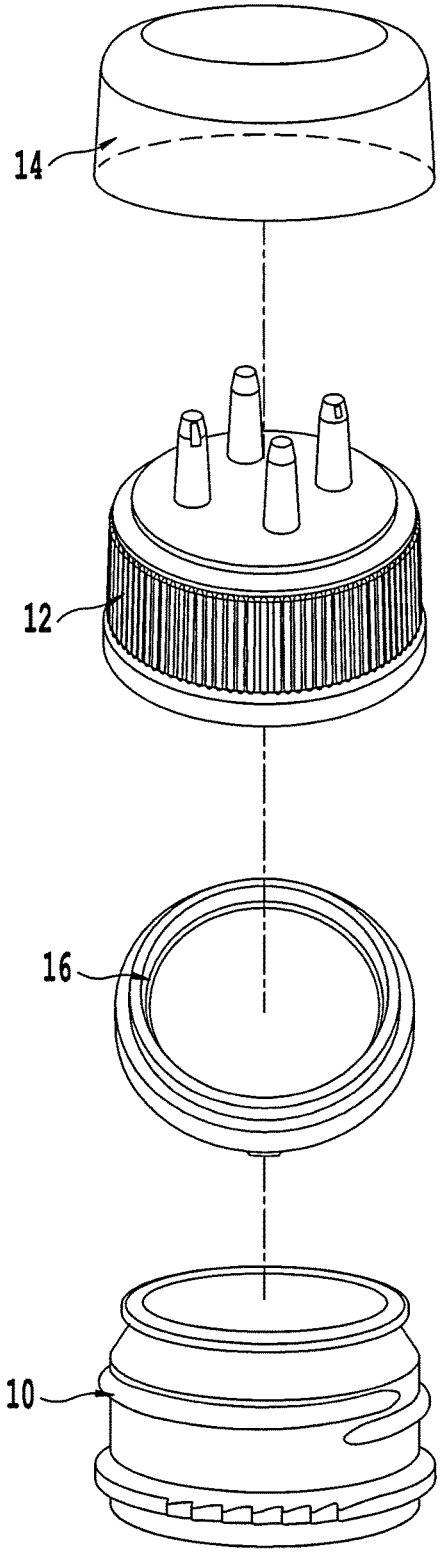
FIG. 16 shows an exemplary embodiment of the components of an injection closure system.

In an alternative embodiment, the fitment 16 could have a plug seal that is inserted into the neck of the bottle 10 to seal the opening, as shown in FIG. 6. FIG. 16 shows an exploded view of the bottle 10, fitment 16, closure 12, and overcap 14 of FIG. 6.

The fitment 16 is snapped over a bead at the top of the neck of the bottle 10. The fitment 16 can be attached to the bottle 10 by either being inserted up into the closure 12 and applied during capping when the closure 12 is torqued onto the bottle 10 in a capper or it could be applied separately to the bottle 10 by a fitment applicator prior to capping.

Figure 5:
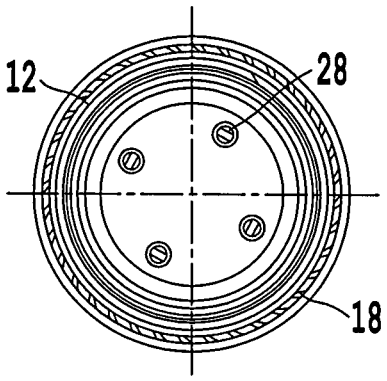
FIG. 5 shows an exemplary injection closure.
Figure 7:
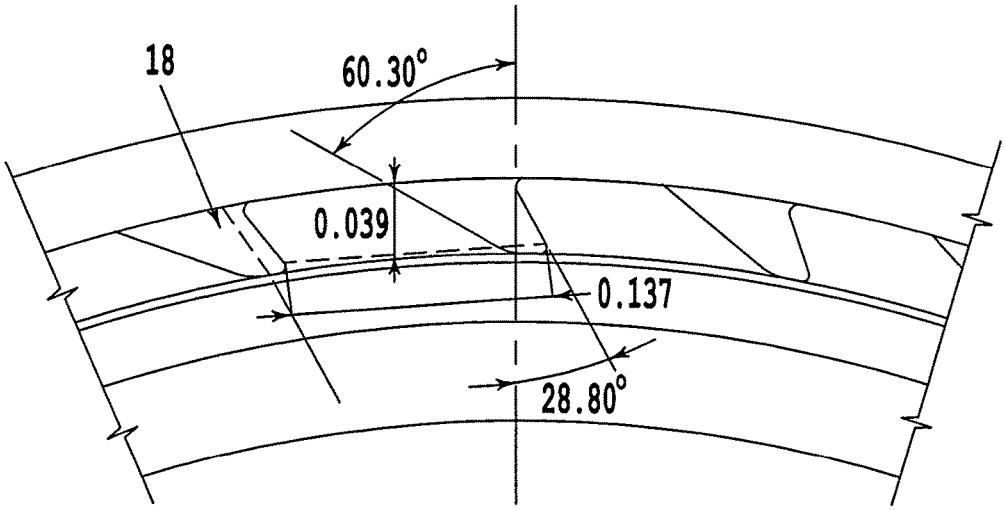
FIG. 7 shows a portion of an exemplary injection closure.
Figure 8:
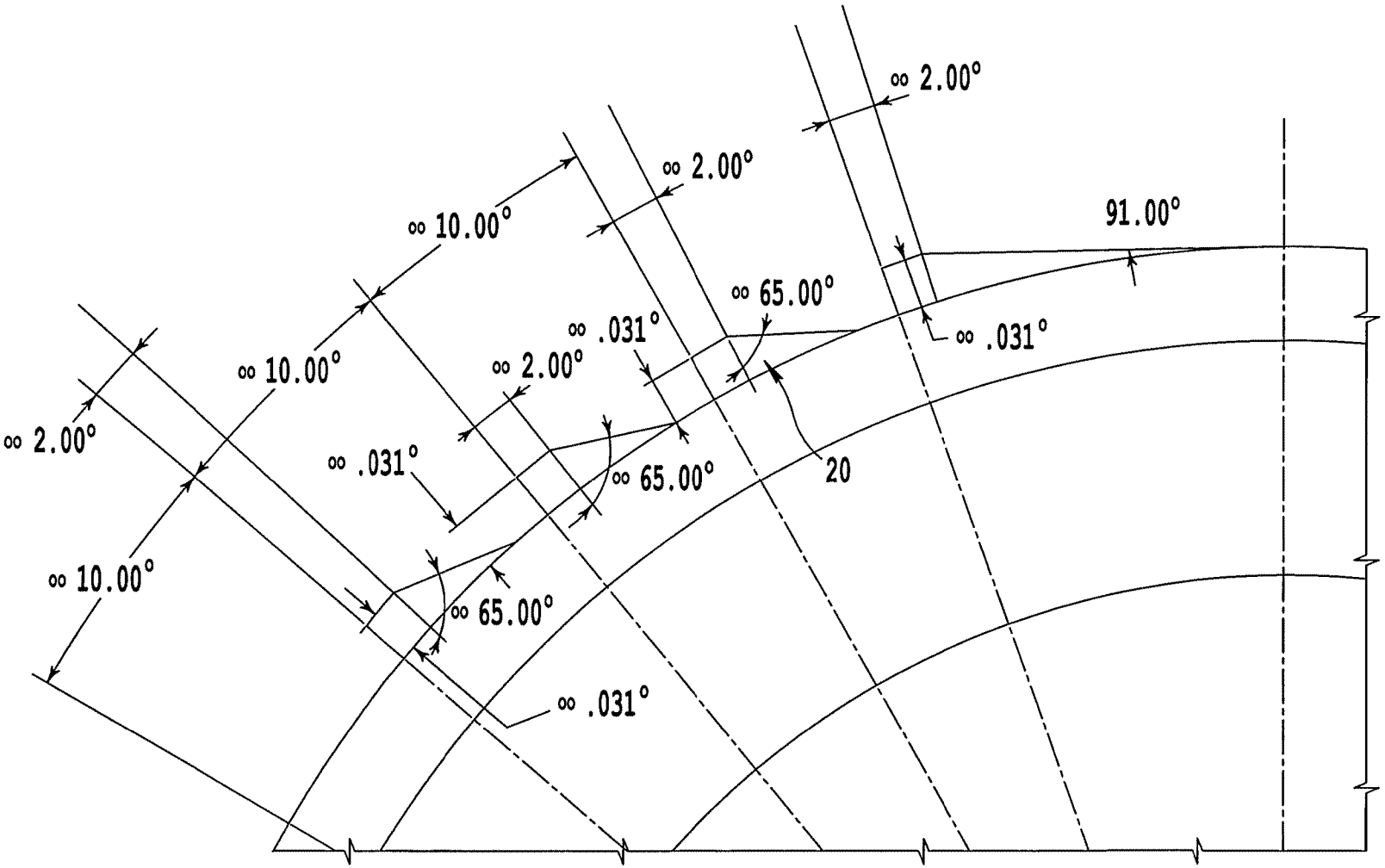
FIG. 8 shows a portion of an exemplary bottle.
Figure 12:
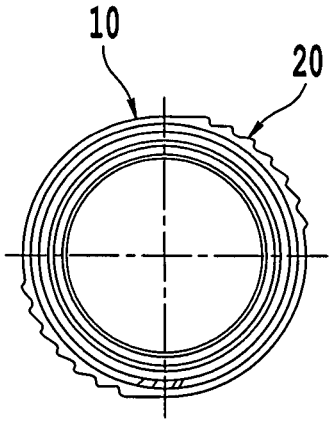
FIG. 12 shows a cross-section of a neck portion of another exemplary bottle.

The closure 12 includes angled teeth 18 extending around an inside surface thereof, as shown in FIG. 5. An exemplary embodiment of the some of the teeth 18 on the inside surface of the closure 12 is shown in FIG. 7. FIG. 7 shows exemplary angles, length, and pitch for the teeth 18 of the closure 12. The bottle 10 includes angled teeth 20 extending around an outside surface thereof. A top view of a neck portion of the bottle 10 is shown in FIG. 12. An exemplary embodiment of the some of the teeth 20 on the outside surface of the bottle 10 is shown in FIG. 8. FIG. 8 shows exemplary angles, length, and pitch for the teeth 20 of the bottle 10. In an exemplary embodiment, the bottle 10 could includes two separate sets of seven teeth 20 positioned on opposite sides of the outside surface thereof. Alternatively, the teeth 20 could extend all of the way around an outside surface of the bottle 10.

Figure 18:
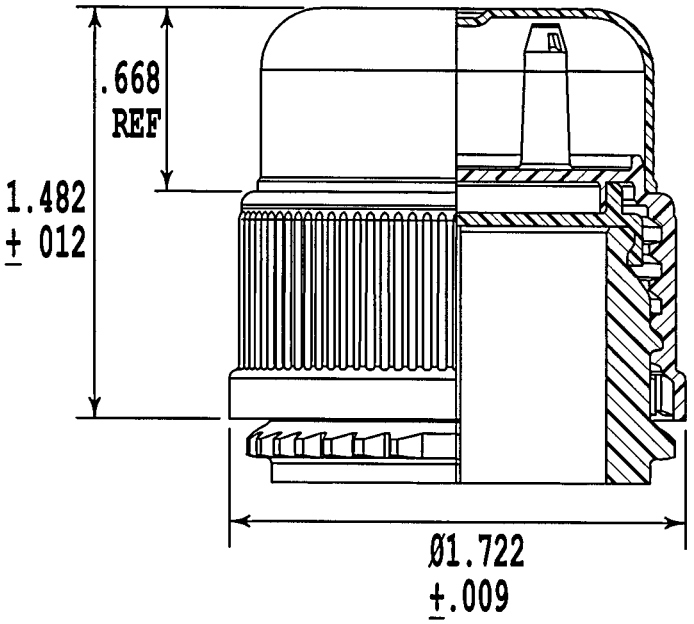
FIG. 18 shows an exemplary embodiment of the injection closure system in the removable position.

When the fitment 16 is positioned on the opening of the bottle 10 as shown in FIG. 2, the closure 12 can only be partially screwed onto the bottle 10, as shown in FIG. 1. The thickness of the fitment 16 prevents the closure 12 from being screwed far enough onto the bottle 10 for the teeth 18 of the closure 12 to contact the teeth 20 of the bottle 10. As seen in FIG. 2, a ring portion of the fitment 16 extends from a top of the neck of the bottle 10 to prevent the teeth 18 of the closure 12 from contacting the teeth 20 of the bottle 10. Thus, the closure 12 is in the removable position (see FIG. 18) such that the consumer is unable to lock the closure 12 onto the bottle 10, as described further below, with the fitment 16 still attached to the bottle 10.

The fitment 16 is removed from the bottle 10 by lifting up along the edge of the fitment 16. A gap between the edge of the fitment 16 and an edge of the bottle 10 is wide enough between the fitment 16 and the neck of the bottle 10 to get a finger under and lift.

Figure 3:
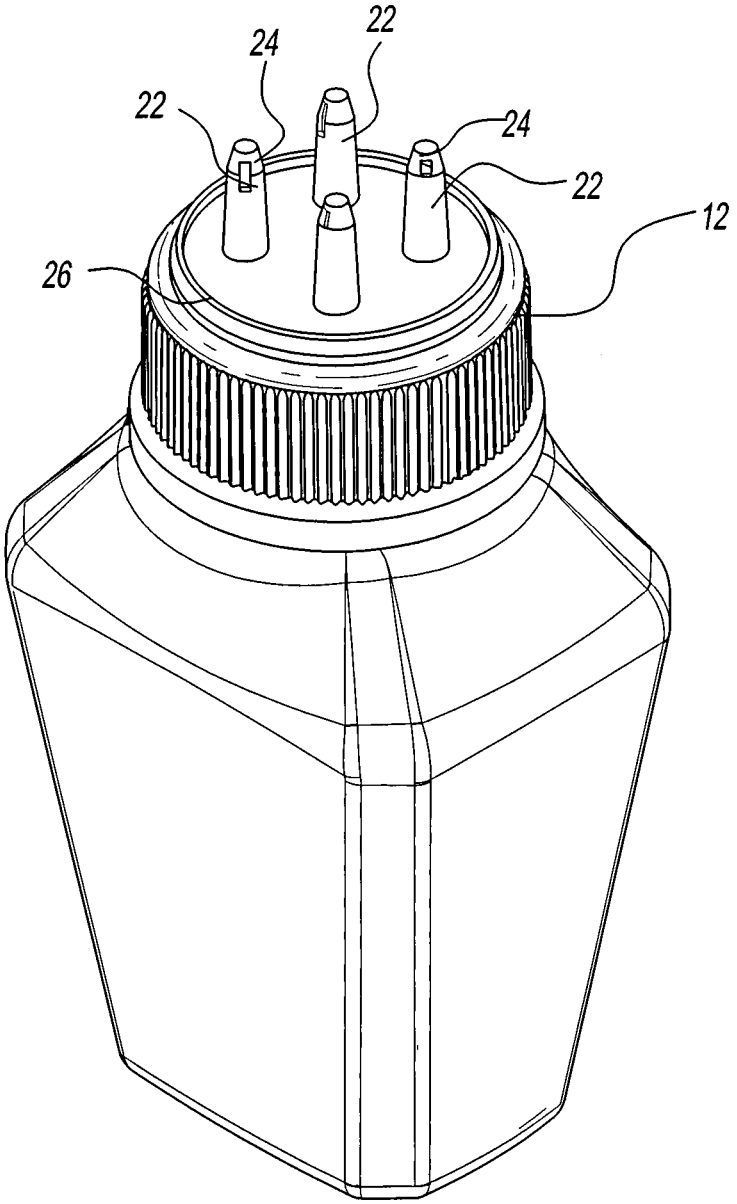
FIG. 3 shows the exemplary embodiment of FIG. 1.

After the fitment 16 is removed from the bottle 10 by the consumer, the closure 12 can be fully screwed onto the bottle 10 (i.e. reach a fully attached position shown in FIG. 3) such that the teeth 18 of the closure 12 contact the teeth 20 of the bottle 10. The teeth 18, 20 are angled as discussed above such that they slide over one another when the closure 12 is being screwed onto the bottle 10 and contact one another when the user attempts to unscrew the closure 12 from the bottle 10.

Figure 11:
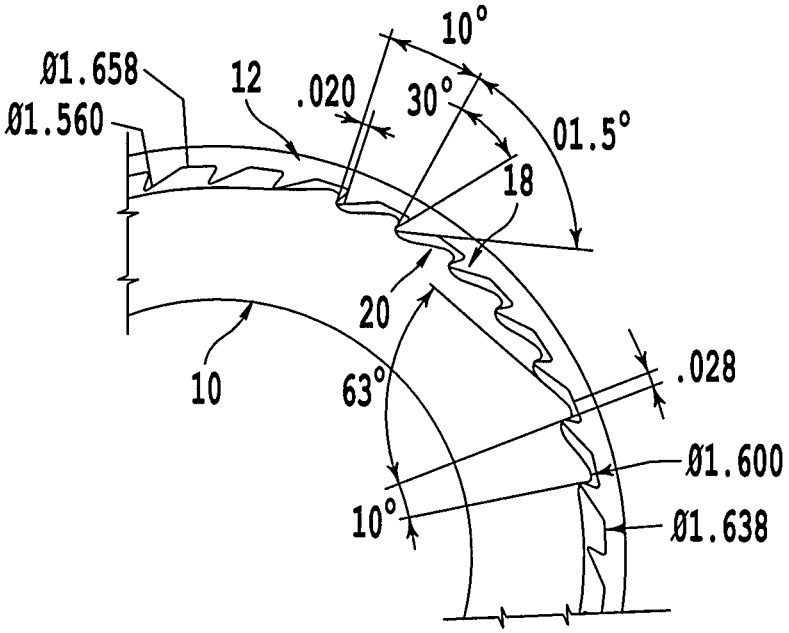
FIG. 11 shows a cross-section of the exemplary bottle and closure of FIG. 1.
Figure 19:
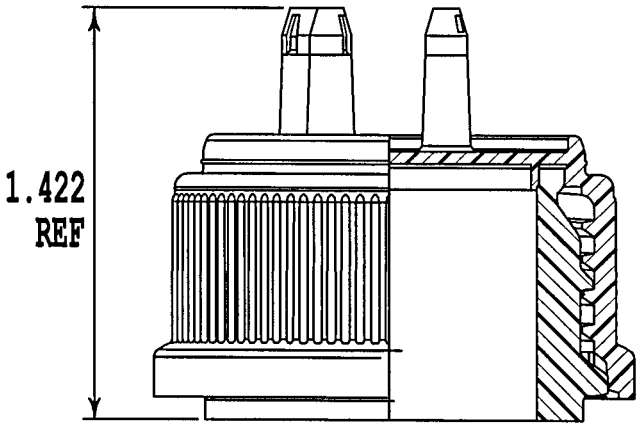
FIG. 19 shows an exemplary embodiment of the injection closure system in the non-removable position.

The teeth 18, 20 act as a non-removable locking feature by contacting one another, as shown in FIG. 11, to prevent the user from unscrewing the closure 12 from the bottle 10. When the closure 12 is fully screwed onto the bottle 10 such that the teeth 18, 20 prevent the removable of the closure 12 from the bottle, the closure 12 is in a non-removable position (see FIG. 19). Because of the non-removable locking feature, in an exemplary embodiment, the consumer will not be able to refill the bottle 10 such that the bottle 10 will be discarded after it has been used. This prevents the consumer from re-using the bottle after the closure has been in contact with raw meat products, as discussed further below.

Figure 9:
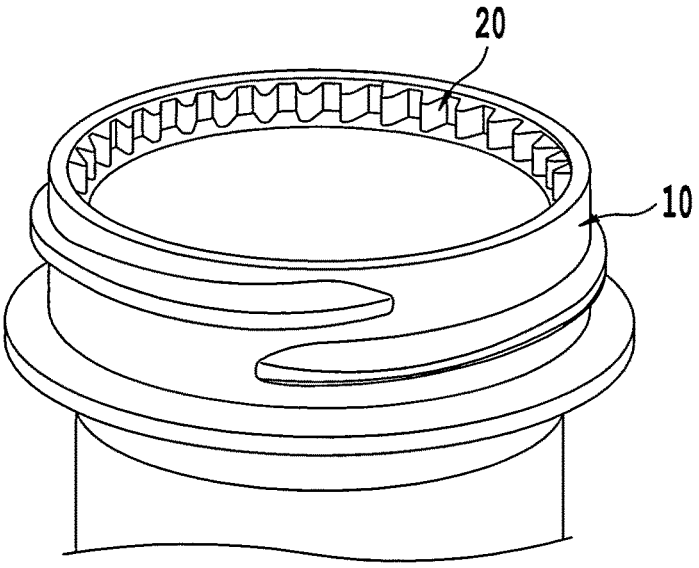
FIG. 9 shows another embodiment of a bottle.
Figure 10:
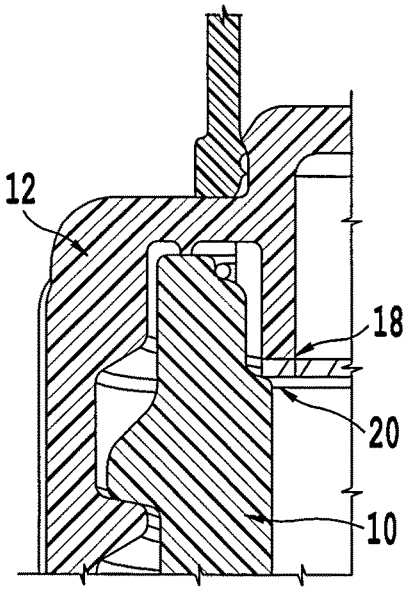
FIG. 10 shows a cross-section of the bottle shown in FIG. 9 with another embodiment of a closure.

In an alternative embodiment, the teeth 20 can be positioned around an inside surface of the neck of the bottle 10, as shown in FIG. 9. The teeth 18 can extend outwardly from a ring within the closure 12, as shown in FIG. 10. With the teeth 20 being positioned within the bottle 10 in this embodiment, the fitment 16 would prevent the teeth 18 of the closure 12 from contacting the teeth 20 of the bottle 10 while the fitment 16 is in place on top of the neck of the bottle 10. However, when the fitment 16 is removed and the closure 12 is screwed onto the bottle 10, the teeth 18, 20 again act as a non-removable locking feature by contacting one another to prevent the user from unscrewing the closure 12 from the bottle 10.

Figure 4:
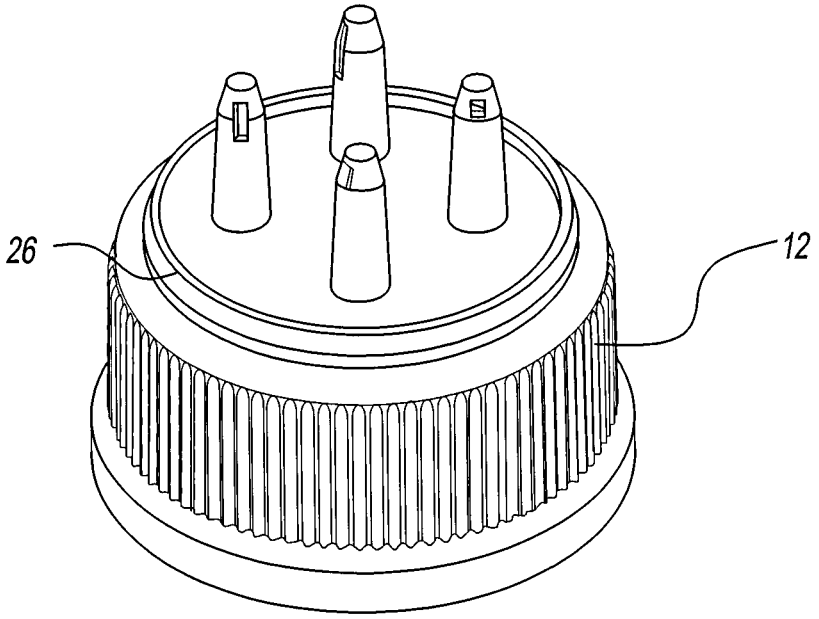
FIG. 4 shows an exemplary injection closure.

As shown in greater detail in FIG. 4, the closure 12 has four built-in injector nozzles 22. The product within the bottle 10 is dispensed through the injector nozzles 22 of the closure 12. The injector nozzles 22 are tapered to allow the nozzles 22 to pierce the food into which the product in the bottle 10 is to be injected. Each nozzle 22 is tapered such that a width of the nozzle continuously decreases from a base of the nozzle to a tip of the nozzle.

Figure 13:
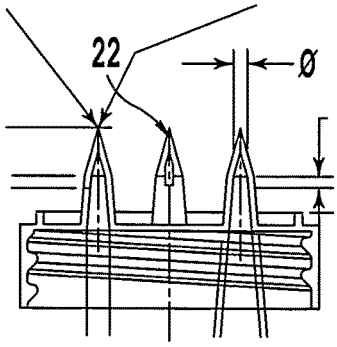
FIG. 13 shows another exemplary injection closure.
Figure 14:
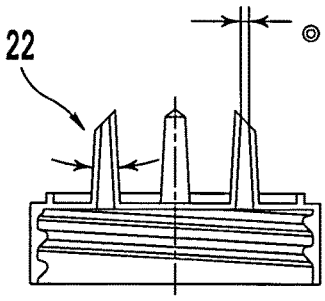
FIG. 14 shows another exemplary injection closure.
Figure 15:
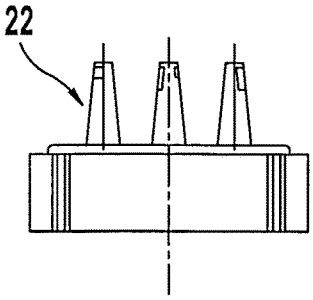
FIG. 15 shows another exemplary injection closure.

In the exemplary embodiment shown in FIG. 4, each nozzle 22 includes a tip portion which has a greater taper than the rest of the nozzle. The tip portion ends in a flat surface that extends radially from an axis of the nozzle 22 and the holes 24 are not located within the flat surface to prevent clogging. In an alternative embodiment, the tip portion could taper down to a point (FIG. 13) or the flat surface could be angled (FIG. 14) relative to the axis of the nozzle such that it does not extend radially. Alternatively, the entire nozzle could have a constant taper down to a point or a flat surface (FIG. 15).

In an exemplary embodiment, the product within the bottle 10 can be a wet sauce, for example a marinade, which is injected into food, for example steak or chicken, for enhancing the flavor of the food. By injecting the marinade into the meat, the bottle 10 with injection closure 12 allows for the meat to marinate from the inside out. The nozzles 22 are sized to prevent the nozzle 22 from passing through a standard cut of meat so that the product will not be injected out of the other side of the meat. In a preferred embodiment, the nozzles 22 are each from 0.4375" to 0.625" long, and more preferably are 0.528" long. However, the length of each nozzle could be re-sized for different cuts of meat. For example, an injection closure system designed to be used with thin cuts of meat, such as chicken cutlets or pork chops, would have shorter nozzles than an injection closure system designed to be used with a rotisserie chicken or whole turkey.

The injector nozzles 22 each have an interior channel 28 (see FIG. 5) that leads to two holes 24 at a specific placement in the nozzle 22 to allow product to be dispensed from the nozzles 22 into the meat. The holes 24 are positioned on a side of the nozzles 22 so that the meat does not clog the holes 24, thereby preventing the product from being dispensed from the nozzles 22. On each nozzle 22, one of the holes 24 is larger than the other hole 24. The smaller of the two holes 24 is sized to allow passage of the product without the product clogging in the hole and the bigger of the two holes 24 is sized to prevent the product from spilling out of the nozzle 24 in a larger amount than desired. Additionally, one of the holes 24 is positioned on an opposite side of the nozzle 22 from the other hole 24 (i.e., 180° apart) and neither hole is facing towards a center of the closure. The holes 24 are positioned at a same height along the nozzle 22. Further, the holes 24 are positioned such that the large hole 24 from one of the nozzles 22 is closer to the small hole 24 from the closest nozzle 22 than the large hole 24 of that closest nozzle 22.

The width of the channel 28 in each nozzle 22 is important to control the flow of the liquid product when the bottle 10 is squeezed as the channel width also effects the flowability of the product. When the channel 28 is too wide, the product pours out too fast. When the channel 28 is too small, the product clogs similar to the hole sizes. In an exemplary embodiment, the preferred inside diameter range of the channel is 0.115" to 0.140". The preferred holes sizes are: for both large and small, width ranges from 0.035" to 0.050" (more preferably 0.040"). The small hole length preferably ranges from 0.050" to 0.060" (more preferably 0.050") and the large hole length preferably ranges from 0.050" to 0.150" (more preferably 0.125").

The number, size, and arrangement of the nozzles 22 and holes 24 allows for uniform distribution of the product from the closure 12 into the meat. The sizes of the channel 28 and holes 24 can be determined based on the product contained in the bottle 10.

In an alternative exemplary embodiment, the closure can include fewer or greater than four nozzles and each nozzle can include one hole or more than one hole, and the size and positioning of each hole can be different than the above-described embodiment. For example, each nozzle can include two holes 90° apart or each nozzle can include three holes placed at different heights along the nozzle. Changing the number, size, and arrangement of the nozzles 22 and holes 24 will alter the distribution of the product.

In the exemplary embodiment shown in FIGS. 1-4, the closure 12 includes a ring 26 surrounding the nozzles 22 such that each nozzle 22 is positioned within the ring 26. The ring 26 is raised from the top surface of the closure 12 to help reduce splashing of the product from between the closure 12 and the meat. In an alternative embodiment, the ring 26 can be omitted from the closure 12.

Next, an exemplary method for using the bottle with injection closure is described.

When the consumer purchases the injection closure system shown in FIGS. 1-4, the consumer will unscrew the closure 12 from the bottle 10 and remove the fitment 16. After the fitment 16 is removed, the closure 12 is screwed onto the bottle 10 until the teeth 18 of the closure 12 overlap with the teeth 20 of the bottle 10 such that the closure 12 is no longer removable from the bottle 10 by unscrewing. The overcap 14 is removed from the closure 12 and then the nozzles 22 are inserted into the food. The bottle 10 is then squeezed to force the product out of the holes 24 of the nozzles 22 and into the food. The consumer then removes the nozzles 22 from the food and, when the nozzle 22 has contacted raw meat, discards the bottle 10 and closure 12 due to contamination. Thus, the injection closure system can be for a one-time use. Alternatively, when the nozzles 22 have not been in contact with raw meat, the consumer can replace the overcap 14 on the closure 12 for storage.

As can be seen in the drawings, the bottle 10 is tapered such that the bottle 10 increases in size from the bottom to a shoulder portion thereof and then decreases in size from the shoulder portion to the neck. This shape of bottle 10 allows the consumer to easily grasp the bottle 10 to insert the nozzles 22 into meat and squeeze the bottle 10 to dispense product therefrom.

In an exemplary embodiment, the bottle preferably holds from 2 oz. to 6 oz., more preferably 4 oz, of the product. As noted above, the product can be a marinade or another liquid flavor.

In an exemplary embodiment, the bottle 10 material is made from low-density polyethylene (LDPE) for easy squeezing. The overcap 14 is clear polypropylene (PP). In an alternative embodiment, the overcap 14 is polyethylene terephthalate (PET). The fitment 16 is either LDPE or high-density polyethylene (HDPE), and the injection closure 12 is PP. All elements of the injection system can be injection molded, with the bottle 10 being injection blow molded or extrusion blow molded.

It should be appreciated that the present disclosure is not limited to the exemplary embodiments shown and described above. Instead, various alternatives, modifications, variations and/or improvements, whether known or that are, or may be, presently unforeseen, may become apparent. Accordingly, the exemplary embodiments, as set forth above are intended to be illustrative, not limiting. The various changes may be made without departing from the spirit and scope of the disclosure. Therefore, the systems and methods according to the exemplary embodiments are intended to embrace all now known or later-developed alternatives, modifications, variations and/or improvements.

The invention claimed is:

1. A food product injection closure system, comprising:

a squeeze bottle containing an injectable food product and comprising a non-removable locking element axially spaced from an open upper end;

a closure mounted to the bottle and comprising integrally formed nozzles and a non-removable locking element axially spaced from the nozzles;

a removable fitment positioned between the bottle and the closure, said removable fitment being sized to overlie the open upper end and preventing the closure from reaching a fully attached position on the bottle; and at least one of said nozzles comprising a closed free end, a tapered portion disposed behind the closed free end and at least one side hole at least partially disposed on the tapered portion, wherein the nozzles have injectable ends sized and shaped to pierce a food so as to allow the injectable food product in the bottle to be injected into the food, and wherein the closure is configured to be non-removably mounted to the bottle after use in food product injection so as to render the squeeze bottle non-refillable.

2. The system of claim 1, wherein the at least one side hole includes two holes through which the injectable food product can flow.

3. The system of claim 1, wherein the removable fitment is such that:

when installed, allows removal of the closure from the bottle; and when removed, allows the closure to become non-removably secured to the bottle.

4. The system of claim 3, wherein:

when installed, the removable fitment spaces the closure from the bottle by a first amount; and when removed, the closure is spaced from the bottle by a lesser amount than the first amount.

5. The system of claim 1, wherein the removable fitment is such that:

when installed, seals the bottle, spaces the closure from the bottle by a first amount, and allows for removal of the closure from the bottle; and when removed, unseals the bottle and spaces the closure from the bottle by a lesser amount than the first amount.

6. The system of claim 5, wherein the non-removable locking element of the bottle includes teeth and the non-removable locking element of the closure includes teeth engagable with the teeth of the bottle to prevent removal of the closure from the bottle.

7. The system of claim 1, wherein the non-removable locking element of the bottle includes external teeth and the non-removable locking element of the closure includes internal teeth engagable with the external teeth.

8. The system of claim 7, wherein when the external teeth of the bottle engage with the internal teeth of the closure, the closure is prevented from being removed from the bottle.

9. The system of claim 1, further comprising a removable overcap positioned on the closure.

10. The system of claim 1, wherein the nozzles comprise four nozzles and the food comprises meat.

11. The system of claim 1, wherein each nozzle is tapered such that a diameter of each nozzle decreases from a base of each nozzle to the tapered portion of each nozzle.

12. The system of claim 1, wherein each nozzle comprises two tapered sections, wherein one of the two tapered sections is the tapered portion.

13. The system of claim 12, wherein one of the two tapered sections is tapered by a first amount from a base of the nozzle to the tapered portion and the tapered portion is tapered by a second greater amount.

14. The system of claim 1, wherein said at least one side hole comprises at least one of:

two side holes of different sizes;

two oppositely arranged side holes of different sizes;

two rectangular-shaped side holes; and two different size and rectangular-shaped side holes.

15. The system of claim 1, wherein the closed free end comprises a closed flat surface and the tapered portion is arranged between the closed flat surface and another tapered portion extending to a nozzle base.

16. A food product injection closure system comprising:

a squeeze bottle containing an injectable liquid food seasoning:

a one-piece integrally formed closure mounted to the bottle and comprising nozzles with closed free ends;

an upper end of the closure comprising a curved retaining surface radially spaced from the nozzles;

a removable cap sized and configured to cover the nozzles and having a lower end configured to engage with the curved retaining surface; and a removable fitment capable of preventing the closure from being non-removably secured to the bottle, wherein, when the removable fitment is in an installed state, the closure is removable from the bottle, wherein, when the removable fitment is in a removed state, and the closure is fully and non-removably locked to the bottle, and wherein, after use, the closure is non-removable from the bottle so as to render the squeeze bottle non-refillable.

17. The system of claim 16, wherein the nozzles have injectable ends sized and shaped to pierce meat so as to allow the injectable liquid food seasoning in the bottle to be injected into the meat via side openings spaced from the closed free ends.

18. The system of claim 16, wherein when the removable fitment is installed, teeth of the closure do not engage with teeth of the bottle and when the removable fitment is removed, the teeth of the closure engage with teeth of the bottle.

19. A non-reusable food product injection closure system, comprising:

a squeeze bottle containing an injectable food seasoning;

a one-piece integrally formed closure mounted to the bottle and comprising nozzles with a tapered inner passage and a tapered outer surface;

the nozzles have injectable ends sized and shaped to pierce meat so as to allow the injectable food seasoning in the bottle to be injected into the meat; and a fitment or seal, wherein, when the fitment or seal is installed, the closure is prevented from being at least one of:

fully installed on the bottle; and/or non-removably secured to the bottle, and wherein, when the fitment or seal is removed, and the closure can be at least one of:

fully installed on the bottle; and/or non-removably secured to the bottle, and wherein, after use in food seasoning injection the closure is non-removably retained on the bottle so as to render the squeeze bottle non-refillable.

20. A non-reusable food product injection closure system, comprising:

a squeeze bottle containing between 2 and 6 ounces of an injectable food seasoning and comprising a tapered and rectangular body portion disposed beneath a neck;

a closure mounted to the bottle and comprising nozzles;

a removable cap sized and configured to cover the nozzles and having a lower end configured to releasably mount the cap to the closure; and the nozzles have closed injectable ends sized and shaped to pierce meat so as to allow the injectable food seasoning in the bottle to be injected into the meat via side openings at least partially arranged on tapered portions extending to the closed injectable ends, wherein, when the closure is fully installed on the bottle, a non-removable locking element of the closure engages with a non-removable locking element of the bottle to prevent removal of the closure from the bottle, and wherein the closure system is configured such that, after use for food seasoning injection, the closure is non-removably mounted to the bottle so as to render the squeeze bottle non-refillable.

21. The system of claim 20, further comprising a fitment or seal, wherein, when the fitment or seal is installed, the closure is prevented from being at least one of:

fully installed on the bottle; and/or no removably secured to the bottle, and wherein, when the fitment or seal is removed, and the closure can be at least one of:

fully installed on the bottle; and/or non-removably secured to the bottle.

* * * * *